United States Patent [19]

Roberts et al.

[11] Patent Number: 5,011,158

[45] Date of Patent: Apr. 30, 1991

[54] NUMISMATIC COIN GAME

[76] Inventors: Rose H. Roberts; James M. Roberts, both of 7525 Sherman Hoyt Ave., Twenty-Nine Palms, Calif. 92277

[21] Appl. No.: 552,863

[22] Filed: Jul. 16, 1990

[51] Int. Cl.[5] ..... A63F 3/00

[52] U.S. Cl. ..... 273/256

[58] Field of Search ..... 273/242, 243, 256, 269, 273/271, 274, 278

[56] References Cited

U.S. PATENT DOCUMENTS

| | | | |
|---|---|---|---|
| 2,026,082 | 12/1935 | Darrow | 273/256 |
| 3,148,885 | 9/1964 | Varlese et al. | 273/256 |
| 3,367,662 | 2/1968 | Charles et al. | 273/256 |
| 3,602,512 | 8/1971 | Krugier | 273/256 |
| 3,749,404 | 7/1973 | Oetzel | 273/243 |
| 4,397,467 | 8/1983 | Thornton | 273/256 |
| 4,637,614 | 1/1987 | Gibbon et al. | 273/271 |
| 4,730,831 | 3/1988 | De Sio | 273/243 |
| 4,871,177 | 10/1989 | Mock | 273/256 |

OTHER PUBLICATIONS

"Stock Market Game", *Playthings,* Jan., 1960, p. 123.
"Meet the Presidents", *Playthings,* Feb., 1959.

*Primary Examiner*—Edward M. Coven
*Assistant Examiner*—William E. Stoll
*Attorney, Agent, or Firm*—Thomas I. Rozsa

[57] ABSTRACT

A coin game which is played on a game board having thereon a multiplicity of individualized landing spaces along the game board path. Each landing space has a specific designation. Along the path, are general landing squares, each representing one of a set of 24 Peace Dollar Series coins. Other landing squares are action squares wherein a player has the option of buying or selling coins, buying or selling silver shares or gold shares, or receiving money. The object of the game is to either collect the entire 24 Peace Dollar Series of coins or alternatively accumulate a sufficient amount of cash so that the player can acquire the rare 1927-D $20 St. Gaudin gold coin for $150,000. The game pits players against each other. Each player is given a certain amount of cash at the start of the game and a playing piece to move along the game board. The game is educational in that it teaches the player about coins and coin collecting and is also a game of both chance and skill. The player must invest wisely in determining how much money to keep as ready cash, how much to invest in gold shares, and how much to invest in silver shares. A random selection device such as a pair of dice are used to determine the number of landing squares along which a player moves and where the player's playing piece lands. Different options are available to the player, depending on which landing space the playing piece lands.

2 Claims, 1 Drawing Sheet

NUMISMATIC COIN GAME

BACKGROUND OF THE INVENTION

1. Field of the Invention

The present invention relates to the field of board games that include a playing board having a specific design thereon and individualized landing squares which create an event upon a player's playing piece landing on the square, and a playing piece for each player which is caused to move around the board along the path of the board, the movement being directed by a random selection device which determines the amount of movement of the playing piece on the board game. Such game is played by several persons in competition with each other to arrive a certain goal pursuant to he rules of the game.

2. Description of the Prior Art

Numerous board games are known in the prior art, both patented and unpatented. The following board games are representative of the known patented board games in the same general area as the present invention:

1. U.S. Pat. No. 3,749,404 issued to Oetzel on July 31, 1973 for "Coin Collecting Game Apparatus".

2. U.S. Pat. No. 4,637,614 issued to Gibbon et al on Jan. 20, 1987 for "Collector's Auction Game".

3. U.S. Pat. No. 4,730,831 issued to De Sio on Mar. 15, 1988 for "Game With Board, Playing Pieces And Award Pieces".

4. U.S. Pat. No. 4,871,177 issued to Mock on Oct. 3, 1989 for "Board Game".

5. An advertisement for a stock market game "Blue Chip" by Technical Ventures of Detroit.

U.S. Pat. No. 3,749,404 issued to Oetzel for the Coin Collecting Game Apparatus illustrated one type of coin board game. The patent discloses a coin collecting game having a set of coins bearing markings related to a given value for the coin. There is also a coin board for each player wherein the board has spaces for putting a coin having a corresponding value placed adjacent the opening in the board. Basically there are a number of coins in a receptacle which is moved in a given manner such that a player can take his specific coin out of the receptacle when it is his turn. When the gets that coin, the player places the coin no the board. The player who basically fills a selected row or all of the coin spaces on his game board is the winner. It is essentially like a tic-tac-toe or filler game, but it is using coins instead of other types of playing pieces.

U.S. Pat. No. 4,637.614 to Gibbon is a Collector's Auction Game toy. The game is designed so that players competitively bid against one another for item cards until a game board representing a house is filled with cards representing items from collections and other items. Extra points are awarded as multiple pieces of a single collection are accumulated. Essentially the concept is that players bid against each other for certain portions of a house such as a sofa, arm chair, dining table, chest, etc. and need to fill up certain areas on a game board with these items. The winning player is the one who first fills a row of certain items.

U.S. Pat. No., 4,730,831 to De Sio is a game with board, playing pieces and award pieces. The game board has a a plurality of paths thereon with each path including a plurality of squares with instructions as to steps to be performed by the player. There is also a playing piece for each player for placing on the board and moving along the paths. There is also a plurality of awards, certain ones of which constitute a part of but less than a complete object. The award pieces also include complete objects and objects being capable of filling together to form a recognized form. Basically the object is to form a sandwich from various types of sections of the sandwich which are awarded by landing on certain pieces of the board such as whole slices, half slices, quarter slices, bread, ham, and cheese.

U.S. Pat. No. 4,.871,177 issued to Mock for Board Game is a business board game in which players attempt to win the game by purchasing or controlling a share of stock of a particular industry or by purchasing a sufficient amount of a stock in each industry so as to block any other player form gaining control of an industry.

The stock market game advertisement contains 16 but name stocks, pretend money, a quotation board, splits, dividends, monetary reports with options to buy at half price, and news reports. The object of the game is to accumulate wealth up to $ 15,000 through stock transactions.

There is a significant need for a new and novel coin game which is both exciting and educational, such as is embodied in the present invention.

SUMMARY OF THE PRESENT INVENTION

The present invention relates to a novel coin game which is played on a game board having thereon a multiplicity of individualized landing spaces along the game board path. Each landing space has a specific designation. Along the path, are general landing squares, each representing one of a set of 24 Peace Dollar Series coins. Other landing squares are action squares wherein a player has the option of buying or selling coins, buying or selling silver shares or gold shares, or receiving money.

The object of the game is to either collect the entire 24 Peace Dollar Series of coins or alternatively accumulate a sufficient amount of cash so that the player can acquire the Rare 1927-D $ 20 St. Gaudin gold coin for $ 150,000 .

The game pits a multiplicity of players against each other. Each player is given a certain amount of cash at the start of the game and a playing piece to move along the game board. The game is educational in that it teaches the player about coins and coin collecting and is also a game of both chance and skill. The player must invest wisely in determining how much money to keep as ready cash, how much to invest in gold shares, and how much to invest in silver shares. A random selection device such as a pair of dice are used to determine the number of landing squares along which a player moves and where the player's playing piece lands. Different options are available to the player, depending on which landing space the playing piece lands. The game is exciting and fun as well as educational. The first player to either fully collect the 24 Peace Dollar Series or purchase the 1927-D $ 20 St. Gaudin gold coin is the winner.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
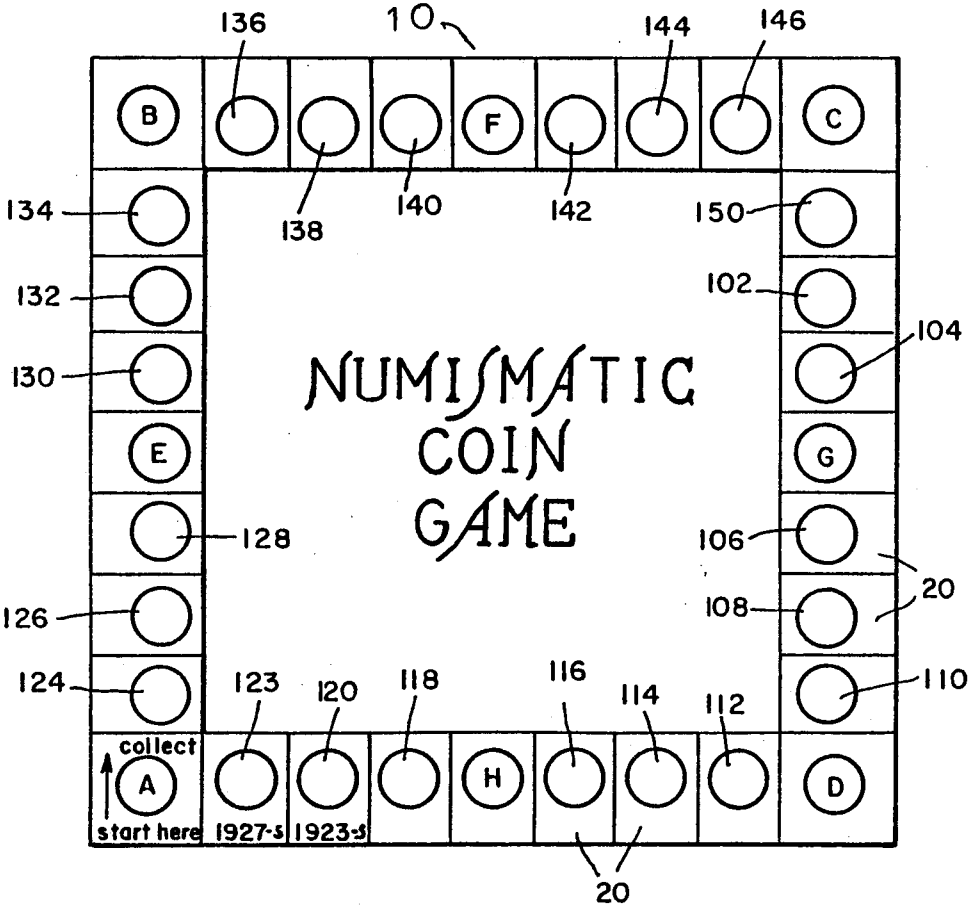
FIG. 1 is a top play view of the game board of the present invention, illustrated with representative symbols to depict the actual landing spaces on the game board.

First the specific playing pieces of the present invention numismatic coin game will be described and then the game itself will be described. Referring to FIG. 1, the present invention is played on a game board 10. Along the perimeter of the game board 10 are a multiplicity of landing spaces 20, with each landing space specifically designated for a specific item or function. Most of the landing spaces are designed to correspond to a specific one coin of the 24 Peace Dollar Series. The various circles on these landing squares depict the specific coin. The following table corresponds to the numbers as marked on the game board to represent the folloWing individual coins in the 24 Peace Dollar Series:

| Landing Space Number | Coin In 24 Peace Dollar Series |
|---|---|
| 102 | 1921 |
| 104 | 1922 |
| 106 | 1922-S |
| 108 | 1923 |
| 110 | 1923-D |
| 112 | 1922-D |
| 114 | 1924 |
| 116 | 1935 |
| 118 | 1935-S |
| 120 | 1924-S |
| 122 | 1925 |
| 124 | 1925-S |
| 126 | 1934-S |
| 128 | 1926-S |
| 130 | 1926-D |
| 132 | 1926 |
| 134 | 1934-D |
| 136 | 1927 |
| 138 | 1928-S |
| 140 | 1934 |
| 142 | 1927-D |
| 144 | 1923-S |
| 146 | 1927-S |

The lower left corner landing space "A" is the Start space which includes the words "Collect 5 Silver Shares Any Time You Stop". The upper left corner landing space "B" is the first "Buy Or Sell Gold Or Silver" space. The upper right landing space "C" is the "Auction" landing space. The lower right corner landing space "D" is the second "Buy Or Sell Gold Or Silver" space. The first middle landing space "E" is the first "Bonus Collect $ 500 Or Any Regular Coin" space. The second middle landing space "F" is the "Go To Auction Start Bid For Key Coin At $ 5,000 Or Pay Auction Fee Of $ 1,000" space. The third middle landing space "G" is the second "Bonus Collect $ 500 Or Any Regular Coin" space. The fourth middle landing space "H" is the "Buy Any Silver Coin Except Key" space. Finally, space 150 is the "1927-D $ 20 St. Gaudin gold coin" space.

There is one game board 10 around which all of the players sit. While any number of players can play the game, it is necessary to have at least 2 players to compete with one another and 4 players can comfortably sit opposite a respective side edge of the game board 10.

Figure 2:
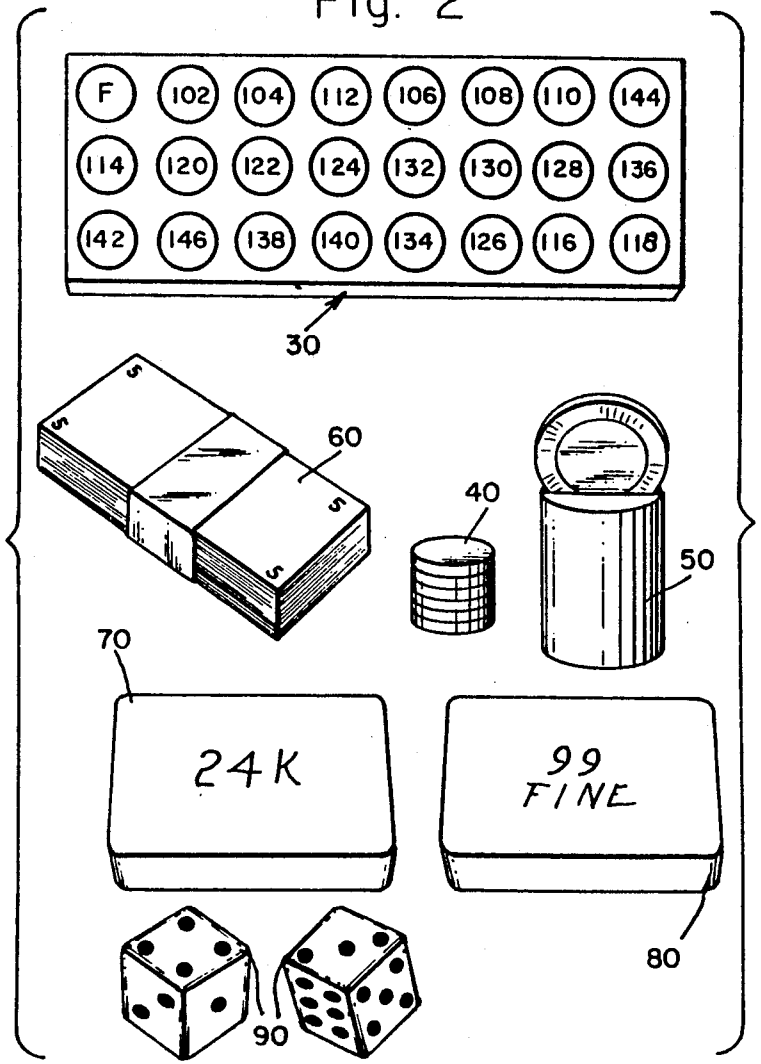
FIG. 2 is a perspective view of the other elements of the board game including a coin board, play money, a playing piece, gold shares, silver shares, and a pair of dice.

Referring to FIG. 2, each player is provided with a coin board 30. Each coin board 30 has 24 spaces therein with each space numbered to correspond to a selected coin in the 24 Peace Dollar Series. By way of example, the coin board 30 may be made of cardboard with 24 independent spaces to accommodate a specific coin. Also included with the game are a multiplicity of coins 40 with a sufficient number of 24 sets to correspond to the number of coin boards 30. Assuming there are 4 coin boards for 4 players, there are 4 sets of 24 Peace Dollar Series coins 40. Each player is provided with a playing piece 50. Also included is play money 60, a multiplicity of individual gold shares 70 and a multiplicity of individual silver shares 80. Finally, a random movement selection device such as a pair of dice 90 complete the game elements.

Therefore, it is the object of the game for each of the competing players to prudently manage their money through a combination of investments in silver shares, gold shares, and ready cash for the purpose of acquiring the 24 Peace Dollar Series or to accumulate sufficient cash to acquire the 1927-D $ 20 St. Gauden Gold Coin. This is combined with the random chance of movement of the playing piece along the game board based on the random selection device such as the pair of dice 90.

The rules of the game can be varied and are all within the spirit and scope of the present invention. The following is an illustrative set of rules. At the beginning of the game, each investor will be given his or her currency of a certain amount of money such as $ 5,000.00 in play money. The player initially makes the decision as to how much of money the player wishes to invest in gold shares 70, in silver shares 80 and retain in ready cash. With the initial prices set at $ 200 per share for gold and $ 50 per share for silver, the player might invest $ 2000 in gold, $ 2000 in silver and retain $ 1000 for playing cash.

Each player is provided with an individual playing piece 50 which is placed on the start landing space "A". Each player has a turn to operate the random movement selection device such as the dice 90. Of course, a spinning dial with numbers and other similar types of numbered random selection devices can be used with the present invention. With the dice rolled, the player moves his playing piece along the game board by the selected number of landing spaces corresponding to the number rolled with the dice 90. The player's option will be determined by the space on which the playing piece lands.

If the playing piece 50 lands on one of the 24 peace dollar series coin landing spaces, numbered 102 through 146 in FIG. 1, then the player will have the option to purchase that particular coin corresponding to the space on which the playing piece 50 has landed. The purchase price is set by the rules of the game or by an individual controller known as the mint director. By way of example, the price of each coin other than a special key 1928-P dollar coin (in space number "F") can be purchased for $ 100. If the playing piece 50 lands on landing space "F" which is the first "Bonus Collect $ 500 or Any Regular Coin" space or on landing space "G" which is the second "Bonus Collect $ 500 or Any Regular Coin", then the player can either obtain an additional $ 500 cash or alternatively select one of the 24 Peace Dollar Series coins for the player's collection. If the playing piece landing on landing space "F" which is "Buy And Silver Coin Except Key" landing space, the player may purchase any one of the 24 Peace Dollar Series coins for the set price. Each coin obtained by either purchase through landing on that coin's landing space or through selection by landing on either spaces "E", "F", or "G" is placed in the individual space allocated for that coin in that player's individual coin board 30.

If the playing piece 30 lands on either landing spaces "B" or "D", the player will have the option to Buy or Sell either gold shares 70 or silver shares 80 at the then prevailing price. If the playing piece 30 lands on space "C", which is the "Auction" space, the player may bid on the key 1928-P Peace Dollar Series coin. If the playing piece 30 lands on landing space "H", this is the "Go To Auction - Start Bid For Key Coin Space", as will be described later.

Finally, if the playing piece 30 lands on landing space 150, the player will have the option to purchase the 1927-D $ 20 St. Gaudin gold coin if the player has sufficient money for the set price, which is $ 150,000.00 .

Each time the playing piece goes past the start landing space "A", the player receives 5 silver shares.

Therefore, through this set of rules and assigned occurrences on the landing spaces, the player can accumulate cash to purchase the 1927-D $20 St. Gaudin coin, or accumulate the 24 Peace Dollar Series coins to win the game.

Therefore, each player can proceed based on different logic. After receiving the initial cash and converting some of it to gold and/or silver shares, as the game proceeds, when landing on spaces "B" or "D" the player can buy or sell additional gold or silver shares.

The goal of purchasing the 24 Peace Dollar Series can be obtained by investing a small amount of cash in gold or silver shares and retaining more cash to purchase the individual coins when landing on that coin space or when landing on spaces "E", "F" or "G".

When the player lands on landing space "H" which is the "Go To Auction" space, the player may bid on any regular coin in the 24 Peace Dollar series except the 1928-P key coin. In one rule, the regular coins bid starts at $ 200 and the 1928-P coin starts at $ 5,000. Players can bid against each other and the highest bidder can purchase either coin. If there are no other bidders, the player whose playing piece 30 landed on that space can buy either coin at the price of $ 200 for regular coins and $ 5,000 for 1928-P coin.

When the player lands on landing space "C" which is the "Key Coin Auction", the player may purchase it for $ 10,000 or pay the mint $ 1,000 dollars auction fee.

The following rules are a further refinement of one illustrative set of rules by which the game is played:

I. Mint Director — Any Player:

1. The Mint Director gives each player their coin holders, pencils and pads. The also receive $ 5,000 dollars in cash. Each player is then asked by the Mint Director how many shares of hold or silver they might wish to invest in. Purchasing is done at current market price. Initially, gold shares at $ 200 per share and silver shares are $ 50 per share.
2. The Mint Director asks each player to select their playing future. The dice is thrown and the one with the highest number starts first.
3. The Mint Director current marketing prices - silver coins (24 Peace Dollar series), gold shares silver shares.
4. Mint Director must give each player their 5 silver shares when any player lands on start here square.
5. Mint Director — when a player lands on Bonus Spots there are two choices, collect $ 500 cash or collect any regular coin free except the key 1928-P coin.

II. Start Here Square:

1. All players are placed on the start here square at the beginning of the game.
2. Each time a player stops on Start Here Square (after going around the board), the mint must give each player their 5 silver shares.

III. Two Bonus Spots:

1. Enables each player to collect a Bonus of $ 500 or collect any regular coin free.

IV. Buy Or Sell Gold Or Silver:

1. When landing on these landing spaces, player can buy or sell gold or silver shares at the current prices.
2. If a player wishes to sell at any other time on their turn, the player can sell to the mint for half of the current price.

V. Go To Auction:

1. When a player lands on a go to auction square, the player may bid on any regular silver coin; including the key 1928-P Peace Dollar Series coin. Regular coins start at $ 200, the key coin at $ 5,000 . The one with the highest bid can buy either coin.
2. The player must have cash to bid. Neither the mint or any other player can perform any buy or sell transactions with the other players.
3. If there are no bidders, the player can purchase the regular coin at $ 200 or the key coin at $ 5,000.

VI. Key Coin (Auction) 28-P Landing Space:

1. When a playing piece lands on Key Coin Auction 28-P landing space, the player may purchase it for $ 10,000 or pay the mint $ 1,000 dollar auction fee in order to keep the coin away from other players.
2. If a player cannot purchase auction fee, the player must then Go To Auction.
3. The Mint starts bidding at $ 5,000. No limit to bidding. This only applied to 1928-P key coin.
4. Player on the throw of 2, on player's turn, may sell the key 1928-P coin to the Mint for Full Market Value ($ 10,000.00).

VII. Regular Silver Coins (24 Peace Dollar Series):

1. All coins start at $100 each and doubles on the throw of 2.
2. The current price can change, even on the first throw at the beginning of the game.
3. Coins cannot be purchased at the beginning of the game.
4. All coins double on throw of 2.
5. Coins may be purchased on the following: (a) go to auction space; (b) two bonus — $ 500 spots; (c) buy any silver coin space; (d) collect any regular coin free space (except key 1928-P space); and (e) landing on specific coin space indicated.
6. Coins may be purchased at the current price throughout the game when the player lands on that specific coin space.

7. Coins can only be sold to Mint. Only on each player's turn at half the current price.
8. Regular Coins Go To Auction Bid space - Meaning bid remains at the starting bid of $ 200 throughout the game — only on this landing space.

VIII. Key Coin — 1928-P:

1. When player land son Key Coin 1928-P landing space, the player may purchase it for $ 10,000 or pay Mint $ 1,000 auction fee. This is in order to keep the coin away from other players.
2. If player cannot purchase or pay auction fee, player must then go to auction.
3. Mint starts the bidding at $ 5,000 . No limit to bidding. This only applies to Key Coin — Go To Auction bid.

IX. Silver Peace Dollar Series:

The completion of this Silver Peace Dollar Series, including the key 1928-P coin, before anyone else purchases the 1927-D $ 20 St. Gaudin Gold Coin, makes that player the winner. The Mint Director then declares that player the winner of the game.

X. 1928-D $ 20 St. Gaudin Gold Coin:

This 1927-D $ 20 St. Gaudin Gold Coin can only be purchased when the player lands on that coin's space (150). The Mint asks the player can you buy it? If not, the game proceeds. But if the player can buy it, Mint Director presents the Rare $ 20 Gold Coin on playing board front and declares that player the winner of the game.

XI. Additional Rules:

1. Go To Auction — gives each player who is investing in the 24 Peace Dollar Series a chance to bid on regular coins at $ 200 or the 1928-P key coin for $ 5,000 .
2. Two Bonus Spots — gives each player who is investing in the 24 Peace Dollar Series a free coin.
3. Investment Prospects — Buying and Selling at current price. Selling to the Mint at half price. Collect 5 silver shares; Bonus Spots of $ 500 or Regular Coin free. Key Coin go to auction 1928-P space.
4 Auctions — are Go To Auction space and Key Coin — Go To Auction 1928-P space.
5. Coins — buying throughout the game. Buy any Silver Coin except Key Coin space indicates that you can purchase any regular coin, at current price, except 1928-P and the $ 20 St. Gaudin Gold coin.
6. The amount of currency each player receives is $ 5000.
7. Dice throw — the very first throw of the game can take coins and gold and silver shares up.
8. Gold and Silver shares — can be purchased at the beginning and throughout the game.

X. Gold And Silver Shares:

1. Gold Shares — sells for $ 200 per share.
2. Gold Shares — Doubles each time the number 12 is thrown, to $ 400 per share, then $ 800 per share, etc.
3. Gold Shares — can be sold on your turn, to the Mint for half current price.
4. Silver Shares — may be purchased at the beginning of the game.
5. Silver Shares — sells for $ 50 per share.
6. Silver Shares — goes up $ 150 each time the number 3 is thrown on the dice.
7. Silver shares — can be sold on your turn, to the Mint for half the current price.

XI. All Buying And Selling Of Gold And Silver:

1. Deals, involves the player and Mint only.
2. Buy or Sell Gold or Silver landing spaces indicates shares sell for current price.

XII. Periodical Checks (Record Keeping):

1. Each player is in control of their own investments. Each player should keep a periodical record of their increase in profits.
2 Mint — at random calls for profit checks for investors, meaning that investors can take this time to evaluate their portfolios.

XIII. Mint Director — Mint Display:

Mint Director's Coin Holder is placed at bottom left hand side of game board. Next, coin box and currency tray. Under Mint's coin holder, place pencil, pad, eraser, silver and gold shares, plus mint chart.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A coin game comprising:

a. a game board having a multiplicity of sequentially arranged landing spaces arranged along a path thereon;
b. a multiplicity of playing pieces for movement along the game board, a selected playing piece assigned to each player of the game;
c. random movement selection means for causing each playing piece to be moved along the path of the sequentially arranged landing spaces and to land on a specific one of the landing spaces;
d. play money, gold shares and silver shares;
e. a selected subset of said sequentially arranged landing spaces representing 24 coins of a Peace Dollar Series, with a specific one coin from the Peace Dollar Series assigned to a selected one of the landing spaces;
f. one of said landing spaces being a start square for positioning the playing pieces at the start of the game;
g. two of said landing spaces each being a bonus square wherein a player whose playing piece lands on the space may collect a sum of money or any one of said Peace Dollar Series coins;
h. two of said landing spaces each being a buy or sell gold or silver space wherein a player whose playing piece lands on the space may purchase or sell gold and silver shares;
i. one of said landing spaces being a buy any coin space wherein a player whose playing piece lands on the space may buy any coin of the 24 Peace Dollar Series except one 1928-P coin;

j. one of said landing spaces being an auction space wherein a player whose playing piece lands on the space may purchase the 1928-P coin of the 24 Peace Dollar Series;

k. one of said landing spaces representing a 1927-D $ 20 St. Gaudin gold coin space wherein a player whose playing piece lands on the space may buy the 1927-F $ 20 St. Gaudin gold coin; and a coin board given to each player to receive coins purchased during the game which represent the 24 coins of the Peace Dollar series and individualized coins representing each coin of the Peace Dollar Series;

m. wherein each player is given a sum of play money at the start of the game and the the rules of the game require the player to invest wisely in gold shares, silver shares and retained play money as the player's playing piece is moved around the board and lands on the landing spaces, and the object of the game is to either collect all 24 coins of the Peace Dollar Series or to be able to purchase the 1927-D $ 20 St. Gaudin gold coin.

2. A coin game comprising:

a. a game board having a multiplicity of sequentially arranged landing spaces arranged along a path thereon;

b. a multiplicity of playing pieces for movemment along the game board, a selected playing piece assigned to each player of the game;

c. random movement selection means for causing each playing piece to be moved along the path of the sequentially arranged landing spaces and to land on a specific one of the landing spaces;

d. play money, gold shares and silver shares;

e. a selected subset of said sequentially arranged landing spaces representing 24 coins of a Peace Dollar Series, with a specific one coin from the Peace Dollar Series assigned to a selected one of the landing spaces;

f. one of said landing spaces being a start square for positioning the playing pieces at the start of the game;

g. a selected subset of the landing spaces being action squares wherein a player whose playing piece lands on a selected square is provided with the event assigned to the square so that the player either receives money, an option to acquire one of coins of the Peace Dollar Series, acquire or sell gold shares, or acquire or sell silver shares;

h. one of said landing spaces representing a 1927-D $ 20 St. Gaudin gold coin space wherein a player whose playing piece lands on the space may buy the 1927-F $ 20 St. Gaudin gold coin; and i. a coin board given to each player to receive coins purchased during the game which represent the 24 coins of the Peace Dollar series and individualized coins representing each coin of the Peace Dollar Series;

j. wherein each player is given a sum of play money at the start of the game and the rules of the game require the player to invest wisely in gold shares, silver shares and retained play money as the player's playing piece is moved around the board and lands on the landing spaces, and the object of the game is to either collect all 24 coins of the Peace Dollar Series or to be able to purchase the 1927-D $ 20 St. Gaudin gold coin.

* * * * *